United States Patent [19]

Soeters, Jr.

[11] 4,221,200

[45] Sep. 9, 1980

[54] CONTROL FOR VALVE DISABLERS

[75] Inventor: Raymond A. Soeters, Jr., Royal Oak, Mich.

[73] Assignee: Eaton Corporation, Cleveland, Ohio

[21] Appl. No.: 610,718

[22] Filed: Sep. 5, 1975

[51] Int. Cl.[3] ..... F02D 13/06; F01L 1/18

[52] U.S. Cl. ..... 123/90.16; 123/90.43; 123/198 F

[58] Field of Search ..... 123/198 F, 90.15, 90.16, 123/90.32, 90.41, 90.43, 90.47, 90.23

[56] References Cited

U.S. PATENT DOCUMENTS

| | | | |
|---|---|---|---|
| 1,797,105 | 3/1931 | Shoblom | 123/90.41 |
| 1,930,568 | 10/1933 | Short | 123/90.43 |
| 2,392,933 | 1/1946 | Mallory | 123/198 F |
| 2,443,999 | 6/1948 | Wright | 123/198 F |
| 2,934,052 | 4/1960 | Longenecker | 123/90.16 |
| 2,997,991 | 8/1961 | Roan | 123/90.16 |
| 3,166,057 | 1/1965 | Konrad et al. | 123/90.16 |
| 3,413,965 | 12/1968 | Gavasso | 123/90.16 |
| 3,422,803 | 1/1969 | Stivender | 123/90.16 |
| 3,470,857 | 10/1969 | Stivender | 123/90.43 |
| 3,964,455 | 6/1976 | Brown | 123/90.16 |

FOREIGN PATENT DOCUMENTS

| | | | |
|---|---|---|---|
| 864080 | 4/1941 | France | 123/198 F |

*Primary Examiner*—Ira S. Lazarus

*Attorney, Agent, or Firm*—R. J. McCloskey; D. Wood; P. Rulon

[57] ABSTRACT

An improved valve disabler control for a multi-cylinder engine having individually pivoted rocker arms and an intake and exhaust valve pair for each cylinder. Half of the valve pairs are provided with valve disablers having rotatable sleeves. Rotation of the sleeves counterclockwise (ccw) allows sliding movement of the rocker arm fulcrums, thereby disabling the valves; clockwise (cw) rotation of the sleeves prevents sliding movement of the fulcrums, thereby enabling the valves. The improved control includes a link and a spring interconnecting the disabler sleeves for each valve pair. Each link rotates the intake valve disabler sleeve ccw in response to ccw rotation of the exhaust valve disabling sleeve. A slot connecting each link to the intake valve disabler sleeve allows cw rotation of the exhaust valve disabler sleeve before cw rotation of the intake valve disabler sleeve. Each spring provides a cw biasing force to the sleeves. The biasing force increases in response to ccw rotation of the sleeves. Actuation of a second valve disabler pair in response to exhaust valve disabler actuation of a first valve disabler pair is provided by a spring-link and slot arrangement interconnecting the exhaust valve disabler sleeves of two valve pairs.

24 Claims, 2 Drawing Figures

CONTROL FOR VALVE DISABLERS

BACKGROUND OF THE INVENTION

1. Field of the Invention

The invention relates to valve disablement and more specifically to a control for actuating valve disablers.

2. Description of the Prior Art

The concept of deactivating selected cylinders of an engine by disabling the valves associated with the selected cylinders is old. When this concept is applied to an Otto Cycle Engine, pumping or throttling losses are reduced, thereby improving engine efficiency during part throttle operation. U.S. Patent Application Ser. No. 578,295, filed May 16, 1975 and assigned to the assignee of this invention, discloses a valve disabler which is simple and inexpensive and which overcomes many of the disadvantages of prior art disablers. This application discloses an improved disabler control adaptable to control the disabler in the mentioned application.

SUMMARY OF THE INVENTION

An object of this invention is to provide a simple, low cost, reliable, and fail safe control for valve disablers.

Another object of this invention is to provide a control which maximizes the time available for shifting valve disablers.

According to a feature of this invention an intake and an exhaust valve pair associated with an engine cylinder are disabled when two flanges connected together by a link are rotated by an actuator connected to one of the flanges and the valves are enabled by a spring means which rotates the flanges counter to the rotational direction of the actuator.

BRIEF DESCRIPTION OF THE DRAWINGS

The preferred embodiment of the invention is shown in the accompanying drawings in which.

DESCRIPTION OF FIG. 1

Figures 1, 2:
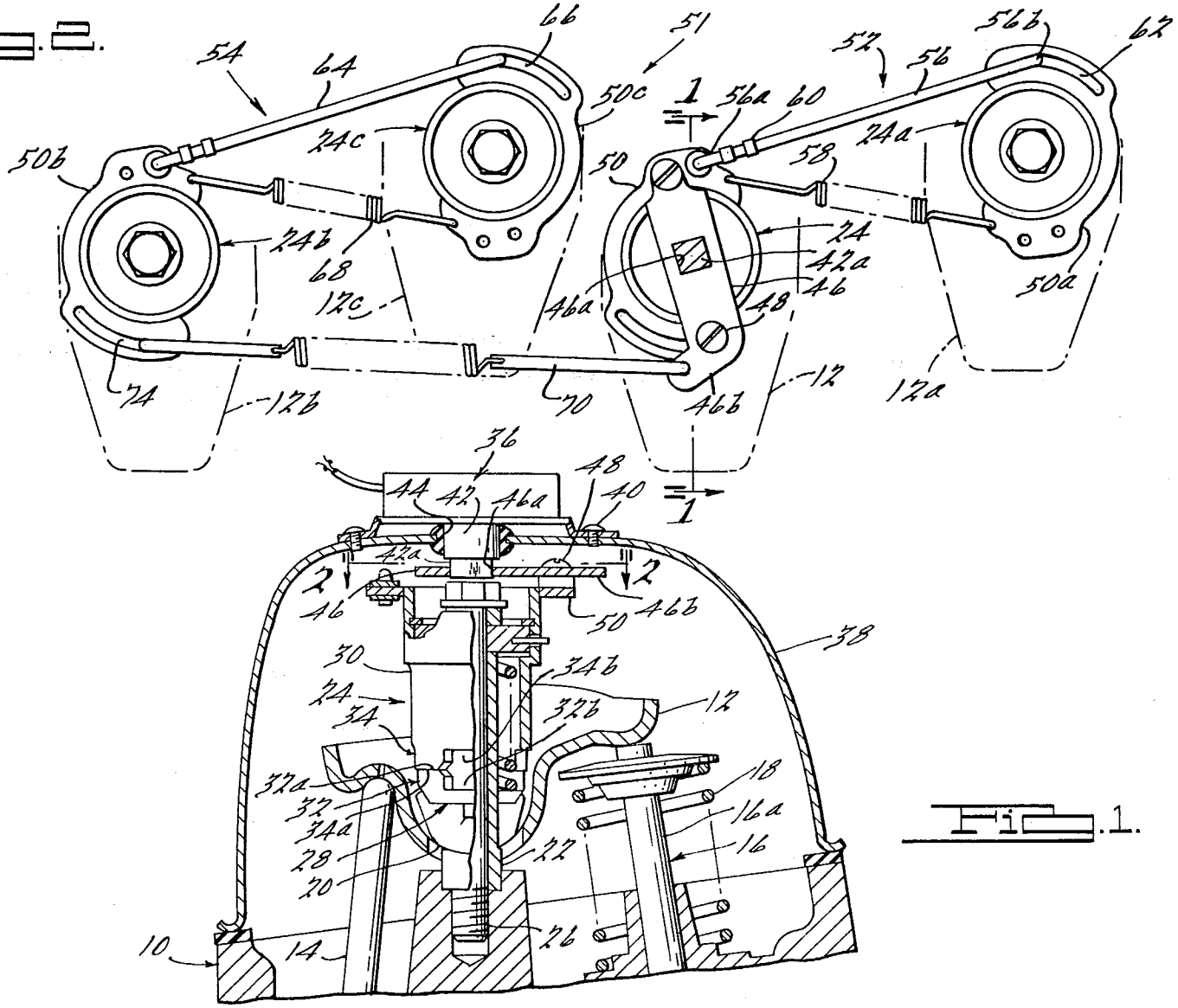
FIG. 1 is a somewhat schematic view of an exhaust valve and its associated drive train which is provided with a valve disabler.
FIG. 2 is a somewhat schematic view of a control arrangement for the valve disablers of two valve pairs in one bank of a V-8 engine.

FIG. 1 schematically illustrates a portion of a valve drive train for a V-8 engine having a partially shown cylinder head 10. The illustrated portion includes a rocker arm 12, a push rod 14, a valve stem 16*a* of a partially shown exhaust valve 16 biased closed by a spring 18, and a fulcrum 20 slideably disposed on a shaft 22 of a valve disabler 24. Shaft 22 is securely fixed to head 10 by a bolt 26.

Disabler 24 includes a non-rotatable latch 28 mounted for sliding movement with fulcrum 20 and a non-slideable sleeve 30 mounted for partial rotation about shaft 22. Latch 28 includes a plurality of circumferentially spaced teeth 32 defining abutting surfaces 32*a* and spaces 32*b*. Sleeve 30 includes a plurality of circumferentially spaced teeth 34 defining abutting surfaces 34*a* and spaces 34*b*. When surfaces 32*a* and 34*a* abut, sliding movement of fulcrum 20 is prevented, thereby enabling valve 16, i.e., valve 16 opens and closes in the conventional manner in response to movement of push rod 14. When surfaces 32*a* and 34*a* align, respectively, with spaces 34*b* and 32*b* fulcrum 20 slides on shaft 22 in response to push rod movement, thereby disabling valve 16.

A more detailed description of valve disabler 24 may be found in patent application Ser. No. 578,295, filed May 16, 1975 and assigned to the assignee of this application.

An actuating force to rotate sleeve 30 from the enabling position, as shown, to the disabling position is provided by rotary solenoid actuator 36. Solenoid actuator 36 is secured to a valve cover 38 by screws 40 and includes a shaft 42 extending through a gromet sealed hole 44 in the cover. Shaft 42 has a square end 42*a* received in a mating hole 46*a* of a cross plate 46. The cross plate is secured by screws 48 to a flange 50. The flange is welded to sleeve 30. Flange 50 and cross plate 46 are best seen in FIG. 2.

DESCRIPTION OF FIG. 2

FIG. 2 illustrates a control arrangement 51 for two intake and exhaust valve pairs 52 and 54 in one four cylinder bank of a V-8 engine. The other four cylinder bank (not shown) is provided with a similar control arrangement. The controls disable the intake and exhaust valve pairs of four of the eight engine cylinders. The four cylinders are chosen so that the power pulses of the other four cylinders are evenly spaced in terms of crankshaft rotation.

Valve pairs 52 and 54 are provided with identical valve disablers 24, 24*a*, 24*b* and 24*c* having identical flanges 50, 50*a*, 50*b* and 50*c*, respectively. Valve disablers 24 and 24*a* of valve pair 52 are associated, respectively with the exhaust valve rocker arm 12, and an intake rocker arm 12*a*. Valve disablers 24*b* and 24*c* of valve pair 54 are associated, respectively with an exhaust valve rocker arm 12*b* and an intake rocker arm 12*c*.

The control arrangement for valve pair 52 includes the flanges 50 and 50*a*, a disabling link 56, a return or enabling spring 58 and the cross plate 46. An end 56*a* of link 56 is bent and pivotally received in a hole in flange 50 and retained by a clip 60. The other end 56*b* is bent and slideably received in a slot 62 in flange 50*a* and retained by an unshown clip. Slot 62 provides a lost motion between flanges 50 and 50*a*, whereby link 56 may be loaded in tension to rotate flange 50*a* ccw but not in compression to rotate flange 50*a* cw. Spring 58 biases the flanges and their respective disabler sleeves cw to their valve enabling positions with a force that increases in response to ccw rotation of the flanges.

The control arrangement for valve pair 54 includes flanges 50*b* and 50*c*, a link 64, a slot 66 in flange 50*c*, a spring 68, and a spring link 70. Spring link 70 is pivotally secured at one end to an extention 46*b* of cross plate 46 and slideably received at the other end in a slot 74 in flange 50*b*. Link 70 applies a ccw force to flange 50*b* in response to ccw rotation of flange 50 by solenoid 36. The spring in link 70 allows ccw rotation of flange 50 before ccw rotation of flange 50*b*. Valve pairs 52 and 54 may be made totally independent of each other by removing spring link 70 and providing each pair with a solenoid and cross plate.

Selective energization of solenoid 36 torques shaft 42 ccw and provides a force effective to rotate flanges 50 and 50*a*, via link 56, only when the exhaust valve and intake valve associated with disablers 24 and 24*a* are inactive, i.e., the ccw force is ineffective to rotate the disabler sleeves when the associated rockers are moving the valves. Solenoid 36 also applies the counterclockwise force to flange 50*b* via spring link 70. The conditions for ccw rotation of flanges 50*b* and 50*c* are the same as those for flanges 50 and 50*a*. The spring in spring link 70 allows rotation of flanges 50 and 50*a* of valve pair 52 before flanges 50*b* and 50*c* of valve pair 54, thereby increasing the shift time available for disabling the two valve pairs, since the number of crankshaft degrees that both valve pairs are inactive at the same time is less than the number of crankshaft degrees that the valve pairs are individually inactive.

Control arrangement 51 is made fail safe by springs 58 and 68 which apply their enabling forces to their respective disablers whether solenoid 36 is selectively deenergized or fails due to a malfunction. The springs are effective to rotate their associated valve disabler sleeves to the enabling position only when the associated valves are inactive. Springs 58 and 68 and their respective links 56 and 64 insure activation of the exhaust valve of each valve pair before the intake valve of each valve pair. Slots 62 and 66 allow rotation of the exhaust valve disabler sleeves to the enabling position before rotation of the intake valve disabler sleeves. Should the intake valve of a disabled cylinder be enabled before the exhaust valve, hot cylinder gases will blow into the engine manifold, thereby disrupting fuel metering and probably causing backfire. The lost motion provided by slots 62 and 66 increases the shifting time available for enabling the disablers. For example, in one particular V-8 engine the intake and exhaust valves of each valve pair are inactive at the same time for 209 crankshaft degrees and individually inactive for a total 684 crankshaft degrees, thereby lengthening the shift time by a factor in excess of three.

A preferred embodiment of the invention has been disclosed for illustrative purposes. Many variations and modifications of the preferred embodiment are believed to be within the spirit of the invention. For example, the disabler sleeves and their respective flanges could be modified to rotate cw for disabling and ccw for enabling, spring 58 of valve pair 52 and its counter part of valve pair 54 could be replaced by two grounded springs, slots 62 and 66 could be dispensed with if shifting time is not critical, or spring link 70 could be dispensed with if individual actuation of each valve pair is desired. The following claims are intended to cover the inventive portions of the preferred embodiment and variations and modifications within the spirit of the invention.

What is claimed is:

1. In an internal combustion engine having means controlling valve disablement of a selected intake and exhaust valve pair, said selected intake and exhaust valves each provided with a valve disabler having means moveable between a valve enabling position and a valve disabling position, the improved means comprising:

means interconnecting said moveable means of the selected valve pair;

actuator means operative when energized to apply an actuating force tending to move both moveable means simultaneously to the disabling position and effecting such movement when the associated valves are inactive;

return means operative to apply a biasing force counter to said actuating force for moving both moveable means to said enabling positions; and lost motion means associated with said interconnecting means and operative to allow movement of one of said moveable means to said enabling position before movement of the other moveable means to said enabling position.

2. In an internal combustion engine having means controlling valve disablement of a selected intake and exhaust valve pair, said selected intake and exhaust valves each provided with a valve disabler having means rotatable between a valve enabling position and a valve disabling position, the improved means comprising:

a link pivotally interconnecting the rotatable means of the selected valve pair;

actuator means operative when energized to apply an actuating force tending to rotate both rotatable means simultaneously to the disabling position and effecting such rotation when the associated valves are inactive;

return means operative to apply a biasing force counter to said actuating force for rotating both rotatably means to said enabling positions; and lost motion means associated with said link and operative to allow rotation of one of said rotatable means to said enabling position before rotation of the other rotatable means to said enabling position.

3. The improved means of claim 2, further including flange means extending from said one rotatable means and fixed to rotate therewith and wherein said lost motion means includes:

a slot in said flange for slideably receiving one end of said link and operative to allow the rotation of the other rotatable means to said enabling position before rotation of said one rotatable means to said enabling position.

4. The improved means of claim 2, wherein said one rotatable means is associated with the intake valve of said selected valve pair.

5. The improved means of claim 2 wherein said return means includes:

a spring interconnecting said rotatable means and operative to increase said biasing force in response to rotation of said rotatable means to said disabling positions.

6. The improved means of claim 2, wherein said actuator means applies said actuating force to the rotatable means of the disabler associated with the exhaust valve of said selected valve pair.

7. In an internal combustion engine having means controlling valve disablement of a selected intake and exhaust valve pair, said selected intake and exhaust valves each provided with a valve disabler having means rotatable between a valve enabling position and a valve disabling position, the improved means comprising;

a link pivotally interconnecting the rotatable means of the selected valve pair;

actuator means operative when energized to apply an actuating force tending to rotate both rotatable means simultaneously to the disabling position and effecting such rotation when the associated valves are inactive; return means operative to apply a biasing force for rotating said rotatable means to their enabling positions in response to rotation of said rotatable means to their disabling positions;

lost motion means associated with said link and the valve disabler associated with the intake valve of said selected valve pair and operative to allow rotation of the rotatable means of the valve disabler associated with the exhaust valve to the enabling position before rotation of the rotatable means of the valve disabler associated with the intake valve to the enabling position.

8. In an internal combustion engine having means controlling valve disablement of a selected intake and exhaust valve pair opened and closed in response to pivotal movement of rocker arms about fulcrums, said selected intake and exhaust valves each provided with a slideable fulcrum and a valve disabler having means moveable between a valve enabling position preventing sliding movement of the fulcrum and a valve disabling position allowing sliding movement of said fulcrum, the improved means comprising:

means interconnecting said moveable means of the selected valve pair;

actuator means operative when energized to apply a force tending to move both moveable means simultaneously to said disabling positions and effecting such movement when the associated valves are inactive;

return means operative to apply a force tending to move both moveable means to the enabling positions and effecting such movement when said actuator means is deenergized and when said associated valves are inactive; and means associated with said interconnecting means and operative to effect simultaneous movement of said moveable means to said disabling position and allowing movement of one of said moveable means to said enabling position before movement of the other moveable means to said enabling position.

9. The improved means of claim 8, wherein said associated means is a lost motion means and allows enabling of the exhaust valve before the intake valve.

10. In an internal combustion engine having means controlling valve disablement of a selected intake and exhaust valve pair, said selected intake and exhaust valves each provided with a valve disabler moveable between a valve enabling position and a valve disabling position, said improved control means comprising:

rotatable means associated with each disabler and operative when rotated in one direction to move the associated disabler to said disabling position and operative when rotated in the other direction to move the associated disabler to said enabling position;

actuator means operative when energized to apply an actuating force tending to rotate said rotatable means in said one direction and effecting such rotation when the associated valves are inactive;

linkage means interconnecting both rotatable means and operative to effect simultaneous rotation of both rotatable means in said one direction in response to rotation of said one rotatable means in said one direction; and return means operative to apply a biasing force counter to said actuating force for rotating both rotatable means in said other direction.

11. The improved means of claim 10, wherein said linkage means includes:

lost motion means for allowing rotation of said one rotatable means in said other direction before rotation of the other rotatable means in said other direction.

12. The improved means of claim 10, wherein said return means includes:

a spring interconnecting said rotatable means and operation to increase said biasing force in response to rotation of said rotatable means in said one direction.

13. The improved means of claim 10, wherein said linkage means includes:

a slot formed in one of said rotatable means; and a link slideably received at one end in said slot and secured at its other end to said other rotatable means, thereby allowing rotation of said one rotatable means in said other direction before rotation of the other rotatable means in said other direction.

14. An improved means for controlling enablement and disablement of a pair of valves normally opened and closed in response to periodic forces in a valve drive train of an internal combustion engine, said improved means comprising:

valve selector means adapted to be associated with each of the valves and having means selectively moveable between a valve enabling position allowing normal opening of the valves by the periodic forces and a valve disabling position preventing opening of the valves by the periodic forces;

linkage means interconnecting said moveable means;

first means for moving both of said moveable means to said valve disabling positions;

second means for moving both of said moveable means to said valve enabling positions; and lost motion means associated with said linkage means and operative to allow movement of one of said moveable means to said valve enabling position before movement of the other moveable means to said valve enabling position.

15. The improved means of claim 14, wherein said moveable means of said valve selector means are mounted for rotation between said valve enabling and disabling positions, said linkage means is pivotally connected to said moveable means, and wherein said lost motion means includes:

a slot in one of said moveable means slideably receiving one end of said linkage means for allowing rotation of the moveable means of the other valve selector means to said valve enabling position before rotation of said one moveable means to said valve enabling position.

16. The improved means of claim 14, wherein said first means includes an actuation means selectively operative when energized to apply an actuating force for moving said moveable means to said valve disabling positions and wherein said second means includes:

resilient means operative to apply a biasing force counter to said actuating force and operative to return said moveable means to said valve enabling positions when said actuation means is deenergized.

17. The improved means of claim 16, wherein said resilient means increases said biasing force in response to movement of said moveable means to said valve disabling positions by said actuator means.

19. The improved means of claim 17, wherein said lost motion means includes:

slot means in one of said rotatable means slideably receiving one end of said linkage means for allowing rotation of other rotatable means to said valve enabling position before rotation of said one rotatable means to said valve enabling position.

20. The improved means of claim 18, wherein said return means includes:

spring means applying a biasing force for rotating said rotatable means towards said valve enabling positions and operative to increase said biasing force in response to rotation of said rotatable means to said valve disabling position.

21. The improved means of claim 18, wherein said return means includes:

a spring interconnecting said rotatable means and operative to apply an increasing biasing force for rotating said rotatable means towards said valve enabling positions in response to rotation of said rotatable means to said valve disabling positions.

18. An improved means for controlling enablement and disablement of a pair of valves normally opened and closed in response to periodic forces in a valve drive train of an internal combustion engine, valve selector means adapted to be associated with each of the valves and having means selectively rotatable between a valve enabling position allowing normal opening of the valves by the periodic forces and a valve disabling position preventing opening of the valves by the periodic forces;

linkage means pivotally interconnecting said rotatable means;

actuator means selectively operative when energized to apply an actuating force for rotating said rotatable means to said valve disabling positions;

return means operative to rotate said rotatable means to said valve enabling positions when said actuator means is deenergized; and lost motion means associated with said linkage means and operative to allow rotation of one of said rotatable means to said valve enabling position before rotation of the other rotatable means to said valve enabling position.

22. An improved means for controlling enablement and disablement of a pair of valves normally opened and closed in response to periodic forces in a valve drive train of an internal combustion engine, said improved means comprising:

valve selector means adapted to be associated with each of the valves and having means selectively rotatable between a valve enabling position allowing normal opening of the valves by the periodic forces and a valve disabling position preventing opening of the valves by the periodic forces;

linkage means pivotally interconnecting said rotatable means;

actuator means selectively operative when energized to apply an actuating force for rotating said rotatable means to said valve disabling positions; and return means applying a biasing force counter to said actuating force and operative to rotate both of said rotatable means to said valve enabling positions.

23. The improved means of claim 22, wherein said return means includes;

a spring interconnecting said rotatable means and operative to apply an increasing biasing force for rotating said rotatable means to said valve enabling positions in in response to rotation of said rotatable means to said valve disabling positions.

24. The improved means of claim 22, further including:

lost motion means associated with one of said linkage means for allowing rotation of one of said rotatable means to said valve enabling position before rotation of the other rotatable means to said valve enabling position.

* * * * *